US009968189B2

(12) United States Patent
Berlino

(10) Patent No.: US 9,968,189 B2
(45) Date of Patent: May 15, 2018

(54) STORAGE SYSTEM EMPLOYING REMOVABLE, AUTOMATICALLY ADJUSTABLE PLATFORM AND REMOVABLE, AUTOMATICALLY ADJUSTABLE PLATFORM EMPLOYABLE WITH SAID STORAGE SYSTEM

(71) Applicant: Penco Products, Inc., Greenville, NC (US)

(72) Inventor: Frank Berlino, Greenville, NC (US)

(73) Assignee: Penco Products, Inc., Greenville, NC (US)

( * ) Notice: Subject to any disclaimer, the term of this patent is extended or adjusted under 35 U.S.C. 154(b) by 0 days. days.

(21) Appl. No.: 14/959,844

(22) Filed: Dec. 4, 2015

(65) Prior Publication Data

US 2017/0156496 A1 Jun. 8, 2017

(51) Int. Cl.
*A47B 57/40* (2006.01)
*A47B 61/00* (2006.01)

(52) U.S. Cl.
CPC ..... *A47B 57/40* (2013.01); *A47B 61/00* (2013.01)

(58) Field of Classification Search
CPC ..... D06F 95/002; D06F 95/004; A47B 57/40; A47B 61/00; A47F 5/10; A47G 29/1223
USPC ..... 232/1 B, 30–32, 43.2; 211/187, 190; 312/351; 248/243
See application file for complete search history.

(56) References Cited

U.S. PATENT DOCUMENTS 2,397,403 A 3/1946 Bishop
2,643,171 A * 6/1953 Sterba ..... A47B 61/00 312/198
3,786,947 A 1/1974 Craft, III
4,447,099 A * 5/1984 French ..... A47B 61/00 16/382
4,971,244 A * 11/1990 Friedman ..... D06F 95/002 232/1 B
5,405,043 A * 4/1995 Meloney ..... D06F 95/002 211/119.004
6,035,973 A * 3/2000 Neal ..... B65G 1/07 187/244
6,044,932 A * 4/2000 Neal ..... B65G 1/07 108/136
6,269,285 B1 7/2001 Mignault
6,769,566 B1 8/2004 Rubin et al.
6,832,865 B2 12/2004 Motamed
6,899,347 B2 * 5/2005 Neal ..... B62B 1/10 108/36

(Continued)

*Primary Examiner* — William Miller
(74) *Attorney, Agent, or Firm* — Benesch, Friedlander, Coplan & Aronoff LLP

(57) ABSTRACT

A platform system removably mountable within an interior compartment of a storage device having a back wall and side walls providing an interior storage compartment. Connecting passages are provided through the back wall and side walls to removably mount the platform system in the interior compartment. The platform system includes a platform and a plurality of connector members attached to the platform and removably connectable through the connecting passages; each connector member including a spring member as part of the construction. The spring members permit automatic downward and movement of said platform as a function of the weight of articles supported on the platform.

17 Claims, 6 Drawing Sheets

(56) References Cited

U.S. PATENT DOCUMENTS

| | | | | |
|---|---|---|---|---|
| 7,487,907 | B2 * | 2/2009 | Miller | A47G 29/1201 232/24 |
| 7,510,249 | B2 * | 3/2009 | Fromme | A47B 47/02 312/216 |
| 8,944,249 | B1 | 2/2015 | Mullaney | |
| 2011/0025181 | A1 * | 2/2011 | Vinke | A47B 57/20 312/257.1 |
| 2012/0176013 | A1 * | 7/2012 | Woods | A47B 61/00 312/270.3 |
| 2015/0014264 | A1 | 1/2015 | Linnell, Sr. et al. | |
| 2015/0113827 | A1 * | 4/2015 | Goulet | F26B 9/06 34/443 |

* cited by examiner

STORAGE SYSTEM EMPLOYING REMOVABLE, AUTOMATICALLY ADJUSTABLE PLATFORM AND REMOVABLE, AUTOMATICALLY ADJUSTABLE PLATFORM EMPLOYABLE WITH SAID STORAGE SYSTEM

BACKGROUND OF THE INVENTION

1. Field of Invention

This invention relates generally to a storage system; more particularly to a storage system in the form of a locker for receiving and storing soiled articles such as wearing apparel; and more particularly to a storage system permitting the easy removal of stored items without requiring an individual to bend excessively during the article-removal process.

2. Background Art

Storage units, such as lockers, are commonly used to store wearing apparel, such as soiled garments, in manufacturing and other locations. Commonly the lockers has an upper, pivotal door moveable between closed and open positions to permit items, such as soiled clothing to be stored. After a period of time the locker needs to be emptied. Commonly a bottom section of a locker door is opened to expose the stored items, which generally are piled on the floor or bottom wall of the locker. Although upper garments initially may be easily removable without requiring excess bending; when garments at or near the floor need to be removed a person emptying the locker needs to bend excessively. In some cases this can cause the person to strain his/her back or otherwise become injured.

Prior art relating to storage units and similar storage devices of interest of this invention include:

1. U.S. Pat. No. 2,397,403 (Bishop), issued May 25, 1945;
2. U.S. Pat. No. 3,786,947 (Craft, issued Jan. 22, 1974;
3. U.S. Pat. No. 6,269,285 (Mignault), issued Jul. 31, 2001;
4. U.S. Pat. No. 6,769,566 (Rubin), issued Aug. 3, 2004;
5. U.S. Pat. No. 6,832,865 (Motamed), issued Dec. 21, 2004;
6. U.S. Pat. No. 8,944,249 (Mullaney), issued Feb. 3, 2015; and
7. U.S. Patent Publication 2015/0014264 (Linnell, Sr., et al.), issued Jan. 15, 2015.

The Motamed '865 patent discloses a spring-loaded catch basket designed to be attached to the outer wall of a document production machine. This basket includes hook members 115 that are removably attached to the outer wall of the document production machine and includes a rectangular sheet support member for supporting a plurality of sheets on it, a frame element above the sheet support member and capable of being coupled to the document production apparatus and a plurality of tension springs having one end connected to the frame element and the opposite end connected to the sheet support member to permit downward movement of the sheet support member in response to the weight of a plurality of sheets being directed into the catch tray. If desired, a shim 131 can be placed on the sheet support member for causing the sheets to be stacked at a desired angle.

Although the '865 patent discloses a downwardly moveable platform to receive a stack of papers, the device does not include hook members or other connecting members attached at the proximal end of tension springs for attachment through openings in walls of a locker and wherein distal ends of the springs include connecting members secured to a base that is movable downward upon the receipt of articles, e.g., soiled laundry, for maintaining a desired elevation of an upper soiled garment on the base. Moreover, in order to obtain an inclined stacking of paper in the '865 device a separate, angular shim member is required.

The Mullaney '249 patent discloses a refuse container including a bottom member that is mounted for downward, vertical movement on lower compression springs 116*a*-116*d*. The container also employs a weight indicator attached to the base to indicate the weight of material supported on the platform for the purpose of determining whether the refuse container can be handled safely.

The Mullaney '249 patent does not disclose a removable base member for a locker or similar storage unit.

The Rubin '566 patent relates to a diaper dispensing device wherein a plurality of diapers is maintained on a shelf 60 that is biased to move upwardly as individual diapers are removed from the stack, to thereby position the next adjacent diaper in alignment with a removal slot.

The arrangement of the moveable platform in the Rubin et al. '566 patent has no relationship to the present invention.

The Bishop '403 patent relates to a food dispenser cabinet having a moveable platform supported on a helical compression spring. The platform is forced upward by the compression spring to continuously position an upper package of food for removal through an upper slot in the cabinet.

This arrangement has no relationship to the present invention.

The Mignault '285 patent employs a spring loaded platform 82 mounted for vertical movement on a compression spring, in a manner similar to that disclosed in the Bishop '403 patent discussed above.

The Craft, III '947 patent discloses a moveable shelf arrangement in a truck. Shelves disposed on each side of the truck, can be inclined toward the center to minimize slippage of the articles during transit. This inclined arrangement is achieved by a complex mounting mechanism substantially different from that employed in the present invention.

The Linnell, Sr., et al. '264 publication discloses a device for storing a plurality of objects, such as trays. This device includes a storage shelf platform 16 designed for movement in a downward direction, as illustrated by the upper position 20 and a lower phantom position 22, upon the placement of food trays or other objects on the platform. The platform 16 is mounted for downward movement through mounting mechanisms provided in side frame members so as to leave the region between the platform 16 and the lower portion of the platform unobstructed for use in receiving empty trays and other objects.

The mounting arrangement for permitting downward movement of the platform 16 in the Linnell, Sr., et al. '264 publication is unrelated to the mounting arrangement provided in the present invention.

BRIEF SUMMARY OF THE INVENTION

A platform system in accordance with this invention is removably mounted within an interior compartment of a storage device, e.g., a locker, including a back wall and transversely spaced apart side walls joined to the back wall. The back wall and side walls provide peripheral walls of the interior compartment, and the back wall and transversely spaced apart side walls each have connecting passages therein configured to permit the mounting of the platform system within the interior compartment, The platform system includes a platform and a plurality of connector members including end sections connected to the platform. The platform is configured to be positioned within the interior compartment of the storage device with peripheral edges thereof closely adjacent said back wall and transversely spaced-apart side walls for providing a lower support for articles to be retained in the storage device. The plurality of connector members are connected to the platform adjacent peripheral edges of the platform in positions for removable attachment within the connecting passages of the back wall and side walls. Each of connector members includes a spring member; preferably a tension spring member for permitting automatic downward movement of the platform as articles, e.g., soiled laundry, are added to the interior compartment of the storage device, and for permitting automatic upward movement as the articles are removed from the interior compartment of the storage device. The spring members are configured for permitting the upper level of articles supported on the platform in the interior compartment to be retained at substantially the same elevation within the interior compartment independent of the number/weight of articles supported on the platform.

In a preferred embodiment the back wall and side walls of the storage device have a plurality of ventilation passages provided therein; selected ventilation passages constituting the connecting passages for receiving the connector members therein.

In another preferred embodiment the back wall and side walls of the storage device can be provided only with the desired connecting passages.

In a preferred embodiment, the connector members each include a hook member adjacent a free end thereof opposed to the end sections connected to the platform, and the hook members are positioned to be removably receivable within said connecting passages.

In the preferred embodiment the spring members are tension springs positioned between the end sections of the connector members attached to the platform and the hook members that are removably receivable within the connecting passages. The invention further relates to the combination of a storage device, e.g., locker and a platform system removably mounted within an interior compartment of the storage device. The storage device includes a back wall and transversely spaced apart side walls joined to said back wall, said back wall and side walls providing peripheral walls of the interior compartment. The back wall and transversely spaced apart side walls each having connecting passages therein, and the platform system includes a platform and a plurality of connector members for releasable connection with the connecting passages. Each of connector members includes an end section connected to the platform and an opposed end section removably connected within a connecting passage with the platform within the interior compartment of the storage for providing a lower support for articles to be retained in the storage device. The plurality of connector members are connected to the platform adjacent peripheral edges of the platform. An opposed end section of each of at least two of connector members being removably connected within a connecting passage in each of said side walls, respectively, and at least one of the connector members being removably connected within a connecting passage of the back wall, each of the plurality of connector members including a spring member for permitting automatic downward movement of the platform as articles are added to the interior compartment of the storage, and for permitting automatic upward movement as articles are removed from the interior compartment of the storage device. This permits the upper level of articles supported on the platform in the interior compartment to be retained at substantially the same elevation within said interior compartment independent of the number or weight of articles supported on the platform.

In the preferred combination of this invention the connecting passages the side walls of the storage unit, e.g., locker, are at a higher elevation than the connecting passages in the back wall. Thus, when the platform system is removably retained within the storage device including the above arrangement of connecting passages the platform slopes upwardly in a direction from the back wall of the storage unit to an opposed, front wall.

Other objects and advantages of this invention will become apparent by referring to the description of the drawings which follows taken in conjunction with the detailed description of preferred embodiments of the invention.

DESCRIPTION OF BEST MODES OF THE INVENTION

Figure 1:
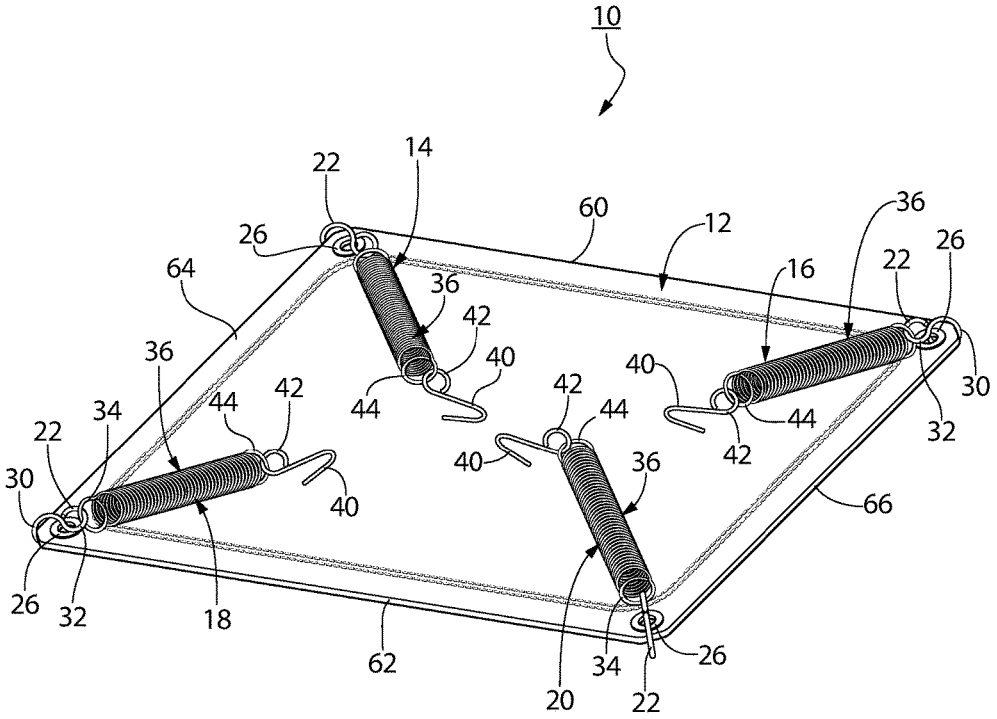
FIG. 1 is an isometric view, of a removable platform system for use with a storage units, e.g., a locker, in accordance with this invention.

A removable and automatically adjustable platform system of this invention is illustrated at 10 in FIG. 1, and a combination of that platform system with a storage unit, such as a locker, is best illustrated at 70 in FIGS. 2-5.

Referring to FIG. 1, the platform system 10 includes a generally planar platform 12 and a plurality of connector members, e.g., 14, 16, 18 and 20 connected thereto.

The platform 12 can be formed of any suitable material, and most preferably is formed from a non-corrosive and rust free material, such as chrome plated steel provided with a plastic coating. The specific composition of the platform 12 does not constitute a limitation on the broadest aspects of this invention. However, when the platform system 10 is utilized in a storage environment in which moisture may be present, such as for the storage of soiled (and possibly moist) clothing, constructing the platform of a non-corrosive and rust free material is desirable.

In a preferred embodiment of this invention, each of the connector members, 14, 16, 18 and 20 are of an identical construction. In the most preferred embodiment, the platform 12 is generally square or rectangular; having four corners, and the above identified four connector members are attached respectively through passages 26 at each of the corners.

In accordance with the broadest aspects of this invention, the configuration of the platform 12 can be varied; depending upon the configuration of the interior compartment of the storage unit in which the platform is to be retained. In addition, the number of connector members employed can be varied depending upon the desired/required support for the platform 12 and the configuration of the interior compartment of the storage device in which the platform system is to be removably mounted. However, regardless of the shape of the platform the connector members should be attached adjacent peripheral regions thereof.

Referring specifically to FIG. 1, the connector members 14, 16, 18 and 20 are of an identical configuration; each including a proximal end section provided by a closed hook 22 connected to the platform 12 through a respective passage 26.

The hook 22 can be of any desired configuration, and in the preferred embodiment is in the configuration of a closed FIG. 8 having one closed loop 30 connected to the platform 12 through a respective passage 26 and the other closed loop 32 connected through a proximal end-coil 34 of a tension spring 36. The particular shape/arrangement of the hook for attaching the tension spring 36 to the platform does not constitute a limitation on the broadest aspects of this invention.

The distal end of each connector member includes a connector preferably in the form of a generally u-shaped hook 40. The hook 40 has a closed segment 42 that is attached to distal end coil 44 of the tension spring 36, opposed to the proximal end coil 34.

Each of the hooks 40 is removably detachable through a corresponding connecting passage extending through a back wall or side walls of a storage device or locker 70, as will be described in greater detail hereinafter. The back and side walls of the storage device can include a plurality of ventilation passages therethrough to permit air movement within the interior compartment, and selected ones of the ventilation passages can be employed as connecting passages.

Referring to FIGS. 1 through 3 and 5, the platform 12, in the most preferred embodiment of this invention, has a back end 60, a front end 62 and sides 64, 66 joining such back end 60 and front end 62. As can be seen best in FIG. 5, the combination of a storage device 70, in the form of a locker, and an adjustable platform system 10 removably mounted in the locker is shown. The locker includes a back wall 72 and transversally spaced apart side walls 74, 76 extending forwardly from the back wall to define an interior compartment 78. A closure 80 of any desired construction is provided adjacent the front end of the locker to provide a closure for the interior compartment 78. The construction/configuration of the closure does not constitute a limitation on the broadest aspects of this invention.

Figure 5:
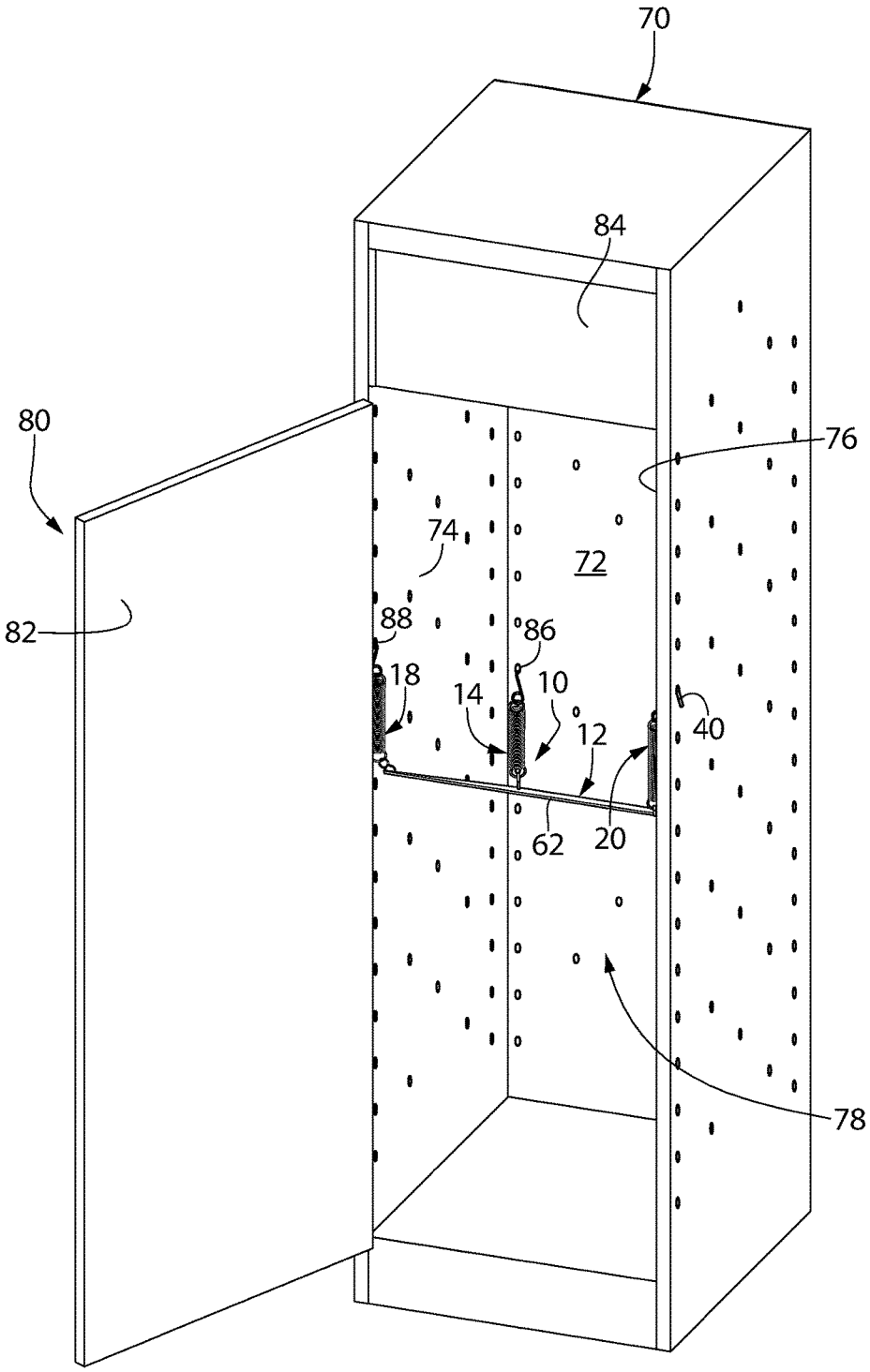
FIG. 5 is an isometric view showing the combination of a locker and an automatically adjustable platform system removably mounted therein.

As is shown in FIG. 5, in a preferred construction the locker 70 is designed specifically for the retention of wearing apparel/garments, and more specifically for the retention of soiled garments/laundry items 81 (FIG. 3) that have been worn in a manufacturing or other work location. In this construction the closure 80 includes a lower door section 82 in the form of a solid member hinged about a vertical axle system so as to permit its movement between an open position exposing the interior compartment 78, and a closed position overlying a portion of the opening into the interior compartment. If desired the lower door portion 82 can include a latch or lock (not shown) as is well known in the art.

The closure 80 further includes an upper panel 84 that is hinged for pivotal movement about a horizontal axle system (not shown) at the upper end of the locker. Preferably the upper edge of the door section 82 overlaps the lower edge of the upper panel 84 when the door section 82 is in a closed position. This provides a completely enclosed interior compartment for articles, such as soiled clothing 81 (FIG. 3) retained within the interior compartment 78. The construction of the locker 70 with a door section 82 and upper panel 84 is well known in the art and needs no further explanation.

In order to store articles, such as soiled clothing 81 within the interior compartment 78 the upper panel 84 is pushed inwardly or rearwardly about its hinged connection to provide an opening into the interior compartment, through which the articles can be inserted. Once inserted through the upper panel 84 the garments are retained on the platform system 10, as will be described in greater detail later in this application.

The closure 80 can be of a variety of different configurations/constructions and such configurations/constructions do not constitute a limitation on the broadest aspects of this invention. For example, the closure can be the full length or height of the storage unit 70 and therefore would not include an upper, hinged panel 84 as in the preferred embodiment of this invention.

Figure 2:
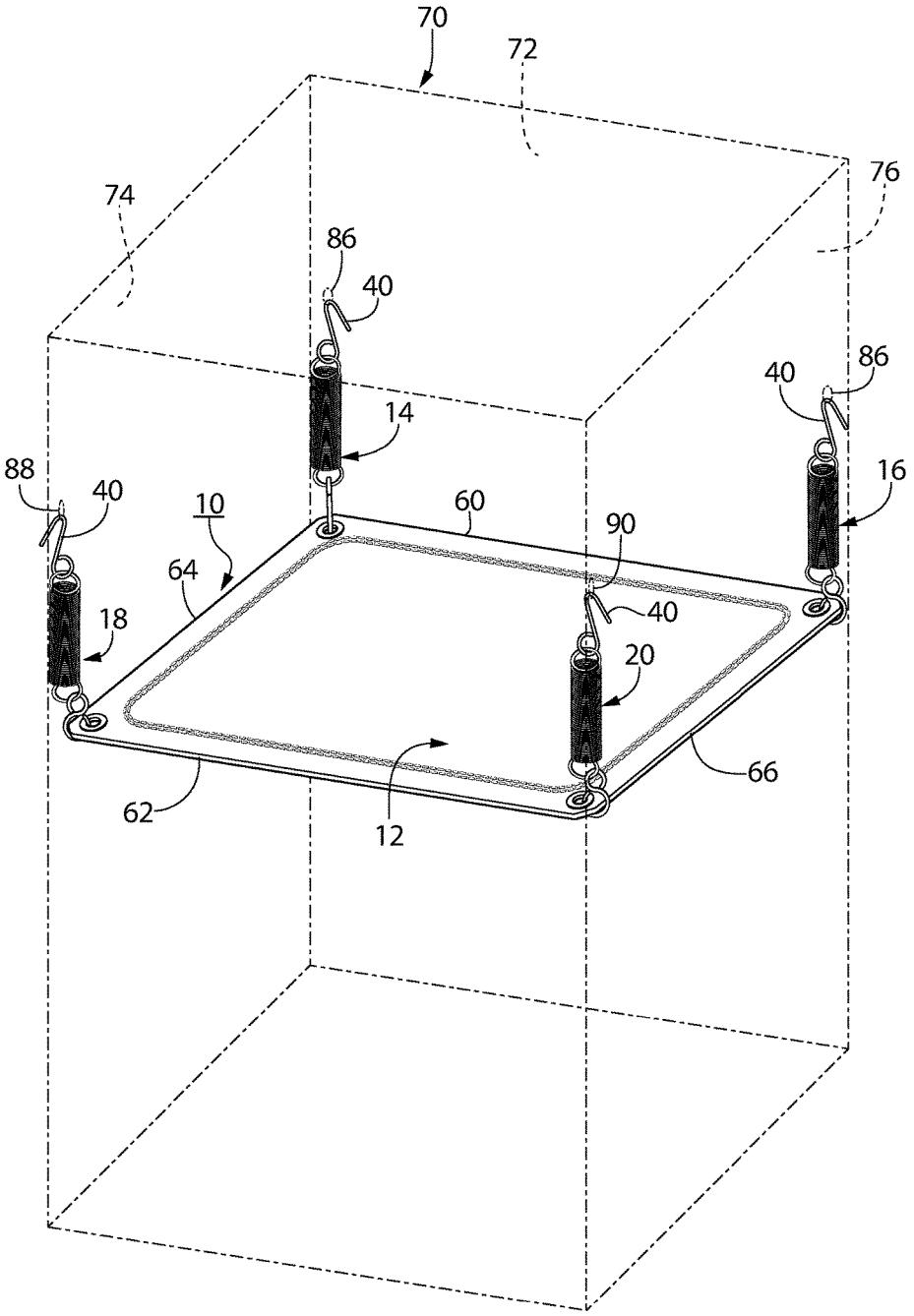
FIG. 2 is an isometric view showing one arrangement for connecting the removable platform system of this invention within a storage unit, said storage unit being illustrated in phantom.
Figure 3:
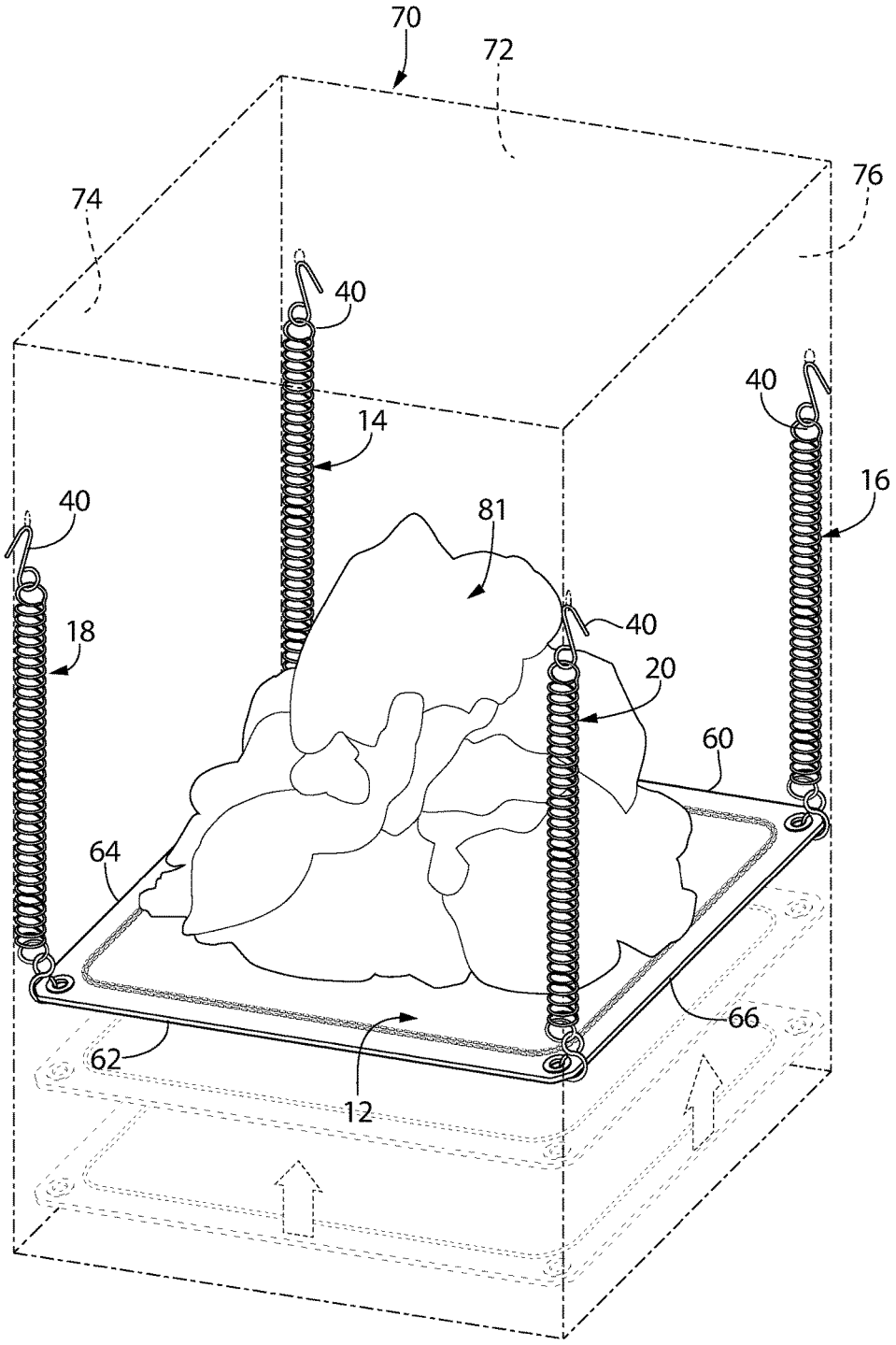
FIG. 3 is an isometric view similar to FIG. 2, but showing the platform supporting a load of soiled clothing in solid representation and showing different positions the platform will assume based upon the change of weight of the clothing positioned on the platform.

As can be seen best in FIGS. 2 and 3, the back end 60 of the platform 12 is positioned closely adjacent to the back wall 72 of the locker; the transversally spaced apart sides 64, 66 of the platform are spaced closely adjacent the transversally spaced side wall 74, 76 of the locker and the front end 62 of the platform is closely adjacent the entrance into interior compartment 78.

As can be seen in FIG. 5, as well as in FIGS. 2 and 3, the connector members 14 and 16 at the corners of the back end 60 of the platform are connected through connecting passages 86 extending through the back wall 72 of the locker. In a like matter, the connector members 18 and 20 adjacent front end 62 of the platform 12 are connected through connecting passages 88, 90 extending through the transversally spaced apart side wall 74, 76, respectively of the locker.

In accordance with this invention the back wall 72 and side walls 74, 76 can be fabricated with a plurality of ventilation passages therein as shown in FIG. 5, and selected ventilation passages can be employed as the connecting passages 86, 88 and 90. However, it also is within the scope of this invention to form only connecting passages in the back wall 72 and side walls 74, 76, of the storage device.

When the connector members 14, 16, 18 and 20 are connected through the above-referenced connecting passages and those passages are substantially at the same elevation, the platform 12 is disposed in a generally horizontal position. Although maintaining the platform 12 in such a horizontal position is within the scope of the broadest aspect of the invention, it is often desired to mount the supporting surface for soiled garments and other articles so that it declines rearwardly from the front end 62 to the back end 60, thereby preventing the articles from falling out of the interior compartment when the door 82 is opened.

Figure 4:
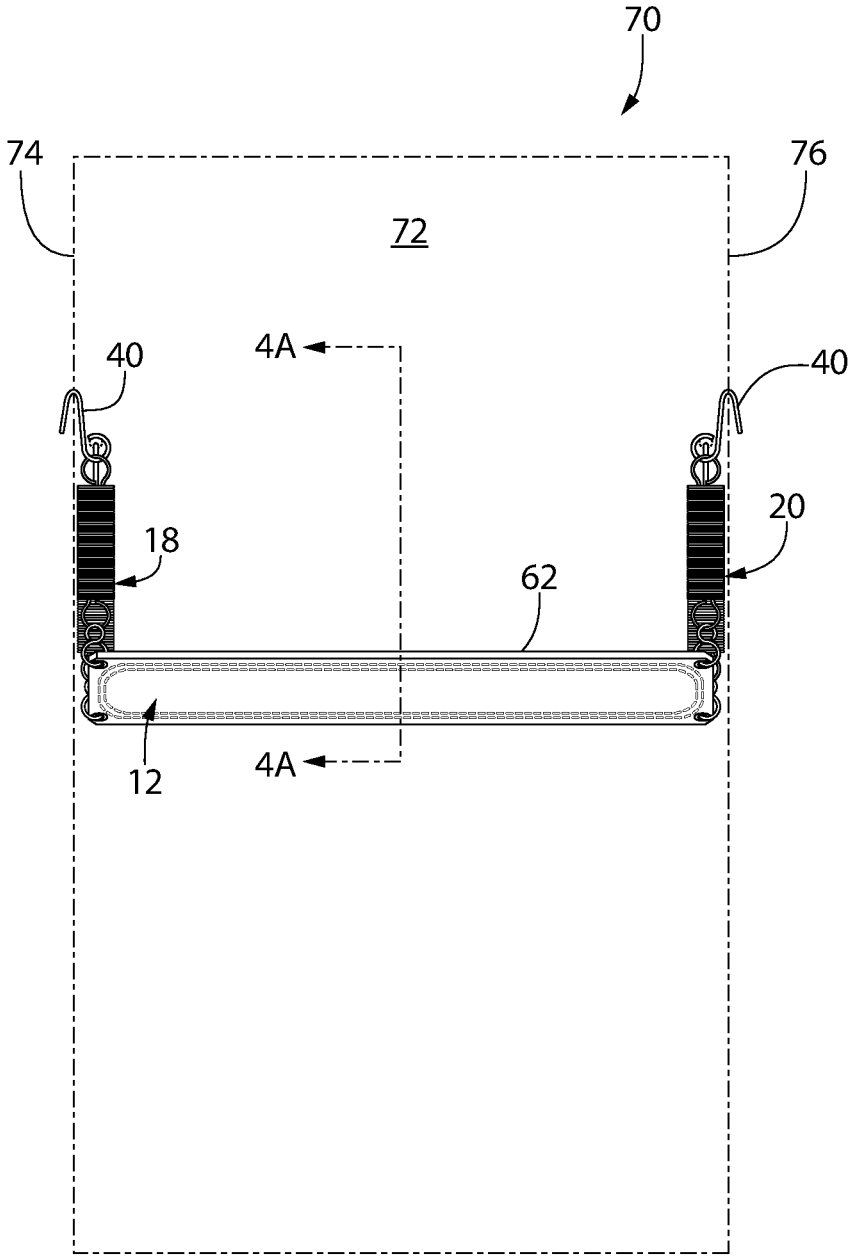
FIG. 4 is a front elevational view of a storage unit, in phantom and with the front wall/door removed, and showing the platform system removably attached to the interior storage compartment with the platform in a preferred, forwardly inclined position.
Figure 4A:
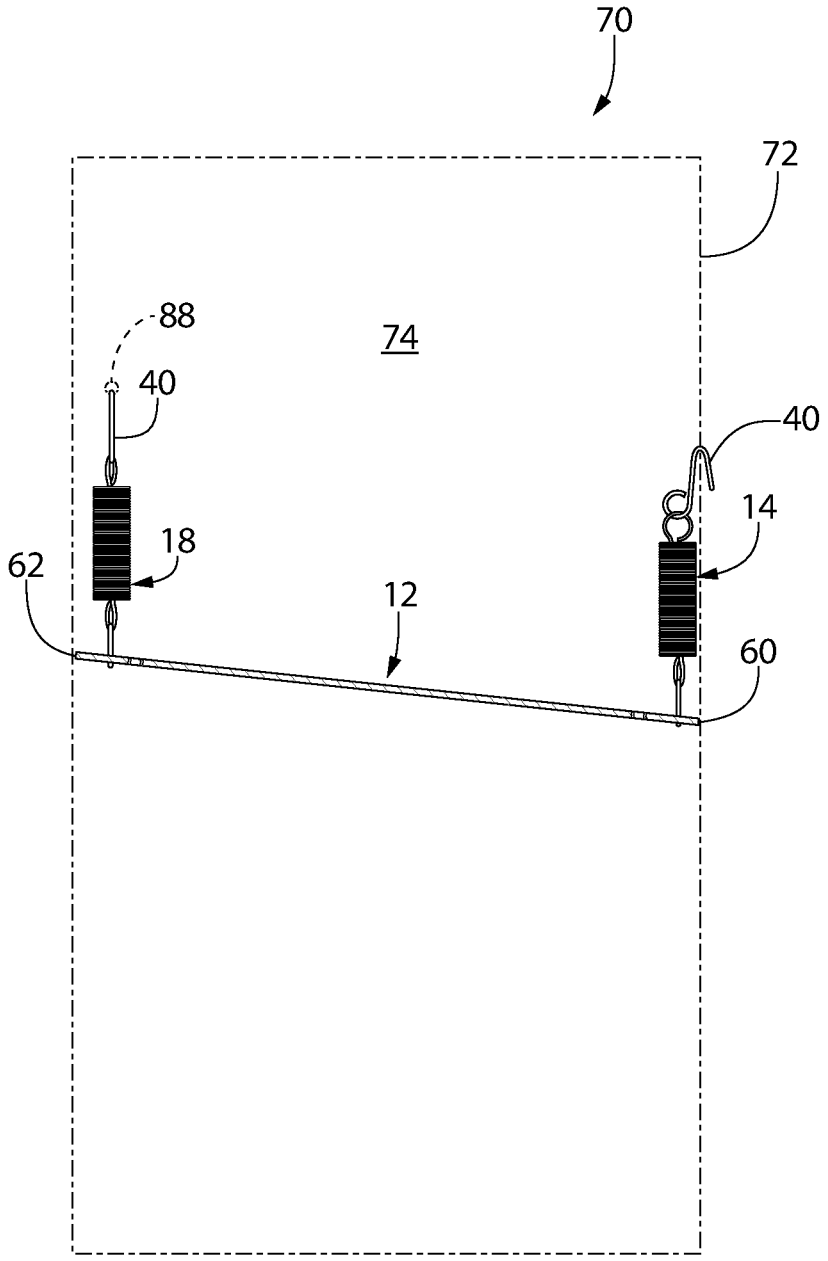
FIG. 4A is a sectional view taken along line 4A-4A of FIG. 4.

Referring to FIGS. 4, 4A and 5, a preferred arrangement is illustrated for attaching the platform system 12 to the back wall 72 and transversally spaced-apart side wall 74, 76 so as to position platform 12 in an orientation wherein back end 60 thereof is lower than front end 62. This results in an upward inclination of the platform 12 in a direction from the back wall 72 of the locker 70 in a forward direction as is illustrated in FIGS. 4, 4A and 5.

The inclined positioning of the platform 12 is achieved by attaching the hooks 40 of rear connector members 14 and 16 through passages 86 in the back wall 72 of the locker 70 that are positioned at a lower elevation than passages 88, 90 that extend through side wall 74, 76 of the locker 70 and through which the hook fasteners 40 of connector members 18, 20 extend.

The arrangement illustrated in FIGS. 4, 4A and 5 clearly is the most preferred arrangement for securing the platform system 12 within a storage unit 70, such as a locker.

Referring to FIGS. 2 and 3, the manner in which the platform 12 automatically adjusts based upon the weight of the articles retained thereon is illustrated.

As can be seen in FIG. 2, the platform system 10 is secured within a storage unit schematically illustrated at 70. It should be noted that the platform 12 is at a predetermined height dictated by the spring constant of the tension springs 36 forming part of the connector members 14, 16, 18 and 20.

As can be seen in FIG. 3, when articles, such as items of soiled clothing 81 are placed on top of the platform 12, the weight of the clothing causes the tension springs of the connector members 14, 16, 18, 20 to expand, thereby resulting in a downward movement of the platform 12. This downward movement tends to position or maintain the upper items of clothing in the stack at substantially the same height or elevation regardless of the amount of clothing placed on the platform. Thus, when the door 82 of the storage device 70 (FIG. 5) is opened to remove clothing, a person removing the clothing does not have to excessively bend to empty the locker. Most preferably the tension springs 36 are selected to maintain the upper items of clothing generally at waist height to eliminate the necessity of a person emptying the locker from having to bend, twist, etc. excessively.

As clothing 81 is removed from the top of the pile 81, the weight on the platform 12 is reduced and platform 12 automatically will move upwardly to compensate for the reduction in weight. This results in maintaining the upper items of clothing at essentially the same height throughout the removal operation or process; preferably at about waist height.

While the invention has been described in detail and with reference to specific embodiments thereof, it will be apparent to one skilled in the art that various changes and modifications can be made therein without departing from the spirit and scope thereof.

What is claimed is:

1. The combination of a storage device and a platform system removably mounted within an interior compartment of said storage device, said storage device including a back wall and transversely spaced apart side walls joined to said back wall, said back wall and side walls providing peripheral walls of said interior compartment, said back wall and transversely spaced apart side walls each having connecting passages therein, said platform system including a platform and a plurality of connector members, each of said plurality of connector members including an end section connected to the platform and an opposed end section removably connected within the respective connecting passage with said platform within the interior compartment of the storage device with peripheral edges thereof closely adjacent said back wall and transversely spaced apart side walls for providing a lower support for articles to be retained in said storage device, said plurality of connector members being connected to the platform adjacent peripheral edges of said platform and the opposed end section of each of at least two of said connector members being removably connected within the connecting passage in the respective side wall, and at least two of the connector members being removably connected within the respective connecting passages of said back wall, each of said plurality of connector members including a spring member for permitting automatic downward movement of said platform as said articles are added to the interior compartment of the storage device thereby increasing the weight of said articles supported on said platform, and for permitting automatic upward movement as articles are removed from the interior compartment of the storage device thereby decreasing the weight of articles supported on said platform, said spring members being configured for permitting the upper level of articles supported on said platform in the interior compartment to be retained at substantially the same elevation within said interior compartment independent of the weight of the articles supported on said platform.

2. The combination of claim 1, including four connector members, each of two of said connector members being removably attached within the respective connecting passage in each of said side walls and two of said connector members being removably attached within respective connecting passages in said back wall.

3. The combination of claim 1, wherein said spring members are tension spring members.

4. The combination of claim 1, wherein said opposed end sections of said connector members including hook members removably retained within said connecting passages.

5. The combination of claim 1, said opposed end sections of said connector members including hook members removably retained within said connecting passages, said spring members being tension springs between said hook members and end sections.

6. The combination of claim 1, said platform being configured for supporting and retaining garments thereon.

7. The combination of claim 1, said platform including a back end adjacent the back wall of the storage device, opposed sides adjacent the side walls of the storage device and a front end spaced forwardly of said back end, said platform sloping upwardly from said back end to said front end when the platform system is removably retained within said storage device.

8. The combination of claim 1, wherein said connecting passages in said side walls through which connector members are attached are at a higher elevation than said connecting passages in said back wall through which connector members are attached, said platform including a back end adjacent the back wall of the storage device, opposed sides adjacent the side walls of the storage device and a front end spaced forwardly of said back end, said platform sloping upwardly from said back end to said front end when the platform system is removably retained within said storage device.

9. The combination of claim 1, including four connector members, each of two of said connector members including an opposed end section removably attached within the respective connecting passage in a respective side wall and two of said connector members including opposed end sections removably attached within the respective connecting passages in said back wall, wherein said respective connecting passages in each of said side walls are at a higher elevation than said respective connecting members in said back wall, said platform including a back end adjacent the back wall of the storage device, opposed sides adjacent the side walls of the storage device and a front end spaced forwardly of said back end, said connector members having opposed end sections removably attached within respective connecting passages in said back wall also having end sections connected to the platform adjacent the back end thereof, said respective connecting passages in each of said side walls being spaced forwardly from the connecting passages in said back wall, said platform sloping upwardly from said back end to said front end when the platform system is removably retained within said storage device.

10. The combination of claim 1, wherein said back wall and side walls of the storage device include a plurality of passages therein for providing ventilation for said interior compartment, selected ones of said plurality of passages constituting said connecting passages.

11. The combination of claim 1, wherein said connecting passages in said side walls through which connector members are attached are at a higher elevation than said connecting passages in said back wall through which connector members are attached, said platform including a back end adjacent the back wall of the storage device, opposed sides adjacent the side walls of the storage device and a front end spaced forwardly of said back end, said connector members being of substantially the same length whereby the platform slopes upwardly from said back end to said front end when the platform system is removably retained within said storage device.

12. The combination of a storage device and a platform system removably mounted within an interior compartment of said storage device, said storage device including a back wall and transversely spaced apart side walls joined to said back wall, said back wall and side walls providing peripheral walls of said interior compartment, said back wall and transversely spaced apart side walls each having connecting passages therein, said platform system including a platform and a plurality of connector members, each of said plurality of connector members including an end section connected to the platform and an opposed end section removably connected within the respective connecting passage with said platform within the interior compartment of the storage device with peripheral edges thereof closely adjacent said back wall and transversely spaced apart side walls for providing a lower support for articles to be retained in said storage device, each of said plurality of connector members including a spring member for permitting automatic downward movement of said platform as said articles are added to the interior compartment of the storage device thereby increasing the weight of said articles supported on said platform, and for permitting automatic upward movement as articles are removed from the interior compartment of the storage device thereby decreasing the weight of articles supported on said platform, said spring members being configured for permitting the upper level of articles supported on said platform in the interior compartment to be retained at substantially the same elevation within said interior compartment independent of the weight of the articles supported on said platform.

13. The combination of claim 12, wherein said connector members include at least two of said connector members removably attached within the respective connecting passage in each of said side walls and at least two of said connector members removably attached within the respective connecting passages in said back wall.

14. The combination of claim 12, said opposed end sections of said connector members including hook members removably retained within said connecting passages, said spring members being tension springs between said hook members and end sections.

15. The combination of claim 12, said platform being configured for supporting and retaining garments thereon.

16. The combination of claim 12, said platform including a back end adjacent the back wall of the storage device, opposed sides adjacent the side walls of the storage device and a front end spaced forwardly of said back end, said platform sloping upwardly from said back end to said front end when the platform system is removably retained within said storage device.

17. The combination of claim 12, wherein said back wall and side walls of the storage device include a plurality of passages therein for providing ventilation for said interior compartment, selected ones of said plurality of passages constituting said connecting passages.

* * * * *